United States Patent [19]

Sussel

[11] 4,170,036

[45] Oct. 2, 1979

[54] ARTICLE OF JEWELRY WITH FLASHING DIODE

[76] Inventor: Howard Sussel, 411 E. 53rd St., New York, N.Y. 10022

[21] Appl. No.: 931,477

[22] Filed: Aug. 7, 1978

[51] Int. Cl.[2] ..... F21L 15/08

[52] U.S. Cl. ..... 362/104; 362/800; 362/806

[58] Field of Search ..... 362/104, 800, 806

[56] References Cited

U.S. PATENT DOCUMENTS

| | | | |
|---|---|---|---|
| 3,383,503 | 5/1968 | Montgomery | 362/104 |
| 3,737,647 | 6/1973 | Gomi | 362/800 X |
| 3,784,760 | 1/1974 | Rickert | 362/800 |
| 3,866,035 | 2/1975 | Richey, Jr. | 362/104 |
| 3,901,121 | 8/1975 | Kleiner | 362/104 X |
| 3,984,674 | 10/1976 | Guetta | 362/104 X |
| 4,035,630 | 7/1977 | Burke | 362/104 |
| 4,076,976 | 2/1978 | Fenton | 362/104 |

*Primary Examiner*—Peter A. Nelson
*Attorney, Agent, or Firm*—Joel Halpern

[57] ABSTRACT

An article of jewelry consists of first and second lengths of electrically conductive wire with a light emitting diode connected across a first set of the free ends of the wire lengths. A restraining diode is connected across the lengths of wire in close proximity to but inwardly of the first set of free ends. The restraining diode is electrically connected in opposition to the current flow through the light emitting diode. A linear integrated oscillator circuit and a low voltage power source are connected across the other set of free ends of the lengths of wire to provide the flashing circuit for the light emitting diode.

12 Claims, 8 Drawing Figures

ARTICLE OF JEWELRY WITH FLASHING DIODE

BACKGROUND OF THE INVENTION

The present invention relates to electronic flashing devices and more particularly to an article of jewelry such as a necklace which features a flashing light element that is operable at extremely low voltage of the order of little more than one volt and which possesses enhanced operational longevity.

Various devices have been known heretofore which utilize oscillator circuits to control the activation of indicator lights. Such devices, however, have generally been employed with installations which are stationary where a relatively high voltage power source is readily available. With the advent of linear integrated circuits attempts have been made to market battery-operable portable equipment. However, the power drain has been found to be great, and the use of such devices has not met with any degree of public acceptance. Even the employment of light emitting diodes has been found to constitute a drain upon the power source. For example, it is estimated that in such instances the customary 9 volt radio battery would last only a few hours. It has thus not been practical heretofore to produce a novelty item with electronic components such as a necklace or bracelet requiring a source of electric power because of the inordinate weight which would have to be carried and in view of the prohibitive cost of battery replacement.

Recently National Semiconductor Corp. designed a simple linear integrated oscillator circuit which has been marketed under the designation LM3909. The circuit is operable with a single cell battery havning a voltage as low as 1.1 volts. This development has made it possible to increase the longevity of the battery power source so as to be operable over a period of several months and has also minimized the weight of the electronics package. The availability of such an oscillator circuit has led to its use with low voltage batteries in indicator light applications such as are employed in emergency equipment, boat mooring floats, etc.

It will be appreciated that the various problems encountered in the design and maintenance of novelty articles such as articles of jewelry where the light emitting diode and its lead outs may be subjected to flexural stresses are quite different from those in the aforementioned fields. Repeated flexure of the relatively weak lead outs for the light emitting diode would normally result in the rupture of such lead outs and require repair or replacement of the diode well before the need to replace the battery would arise. It will, therefore, be recognized that despite the commercial availability of the LM3909 integrated circuit jewelry designers and others in the field of electronic novelty articles have apparently be unable to apply the technology represented by the LM3909 to the production of such articles.

SUMMARY OF THE INVENTION

It is one object of this invention to provide an article of jewelry featuring a flashing light element which is energized by means of a linear integrated oscillator circuit and a low voltage power source.

It is another object of the invention to provide an article of jewelry of the character described which possesses enhanced operational longevity.

It is still another object of the invention to provide a necklace featuring an intermittently flashing light emitting diode that is protected against damage from repeated flexure in a unique manner which avoids the possibility of short circuiting.

Other objects and advantages of the invention will become readily apparent to persons versed in the art from the ensuing description of the invention.

In accordance with the invention there is provided an article of jewelry which comprises first and second lengths of electrically conductive wire; a light emitting diode connected across a first set of the free ends of the lengths of wire; a restraining diode connected across the lengths of wire inwardly of the connection between the light emitting diode and the lengths of wire and in close proximity thereto, the restraining diode being connected in opposition to the direction of current flow through the light emitting diode; and a linear integrated oscillator circuit and power source connected across the other set of free ends of the wire lengths.

BRIEF DESCRIPTION OF THE DRAWINGS

In order that the invention may be more fully comprehended it will now be described, by way of example, with reference to the accompanying drawings in which.

DESCRIPTION OF THE PREFERRED EMBODIMENTS

Figure 1:
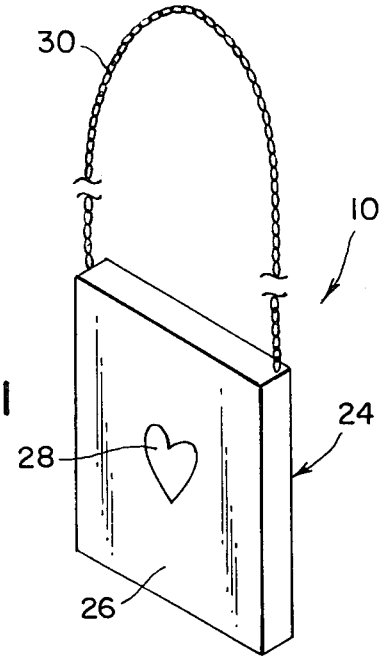
FIG. 1 is a perspective view of an article of jewelry incorporating the features of the invention in accordance with one embodiment thereof.

Before explaining the invention in detail it is to be understood that the invention is not limited in its application to the details of construction and arrangement of parts illustrated in the drawings since the invention is capable of other embodiments and of being practiced or carried out in various ways. It is also to be understood that the phraseology or terminology employed is for purpose of description only and not of limitation.

Referring to the drawings, in which like parts are similarly designated, there is shown a necklace 10 including lengths of electrically conductive wire 12, 14. Since the article depicted is to be worn in close contact with the person the wires should be of the insulated type. A light emitting diode 16 of conventional design is connected across a first set 18 of free ends of the lengths of wire. Inwardly of the first set of free ends 18, in close proximity to the connection of diode 16 with the wires and in elctrically parallel relation therewith, there is connected a second diode 20 which will be described hereinafter as a restraining diode. As can be seen from the schematics of FIGS. 6 and 7 the diode 20 is connected in opposed current flow relationship to diode 16. The lead-outs of the restraining diode 20 are heavier than those of the light emitting diode which enables diode 20 to serve as a mechanical reinforcement for the light emitting diode thereby providing such diode with added physical strength and resistance to repture under the repeated conditions of flexure normally encountered in use of an article of jewelry of the character described. At the same time, by being connected in opposed current flow relationship the oscillator circuit is protected against short circuiting. This unique arrangement of the diodes is believed to make feasible the production of an article of jewelry such as a necklace where a standard production light emitting diode with its relatively weak lead-outs would be expected to fail mechanically under the influence of the repeated flexural stresses.

The second set of free ends of the wire 22 carry an electronics package identified generally by reference numeral 24. The package will be described in greater detail; however, suffice to state at this time that it includes a receptacle 26 within which there is carried the electronics components.

In the embodiment shown in FIG. 1 receptacle 26 is provided with a transparent or translucent section 28 which may, if so desired, be given the configuration of a heart or another emblem for decorative purposes. The light emitting diode in this embodiment is housed within the receptacle and the intermittent occuring flashes can be seen though section 28 thereby creating a particularly aesthetic appearance especially in a dimly lit or dark environment. The necklace is worn such that the receptacle depends from chain 30 worn about the neck in the same manner as the usual pendant. The receptacle thus performs a dual role, i.e. as the housing for the electronics components and as an attractive pendant housing for the light emitting diode. The ends of the chain 30 may be secured to the receptacle in any convenient manner.

Figure 2:
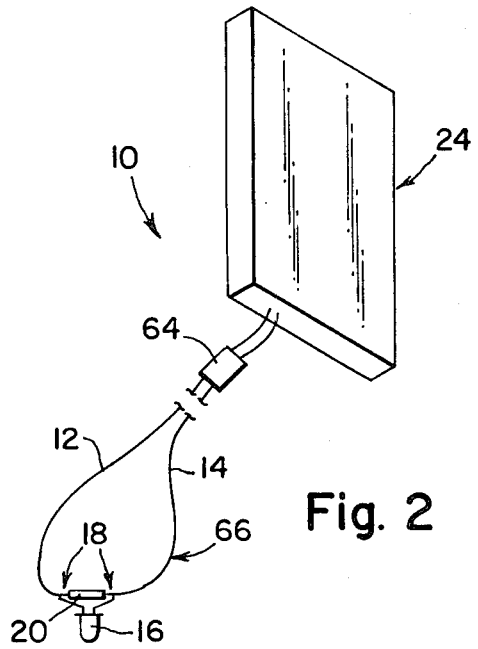
FIG. 2 is a perspective view of an article of jewelry illustrating a second embodiment of the invention.

In the embodiment illustrated in FIG. 2 the receptacle 26 serves as housing for the electronics components and would normally be worn such that the wires drape across the front of the wearer with diode 16 depending therefrom. The receptacle would thus repose upon the nape of the wearer's neck.

Figure 3:
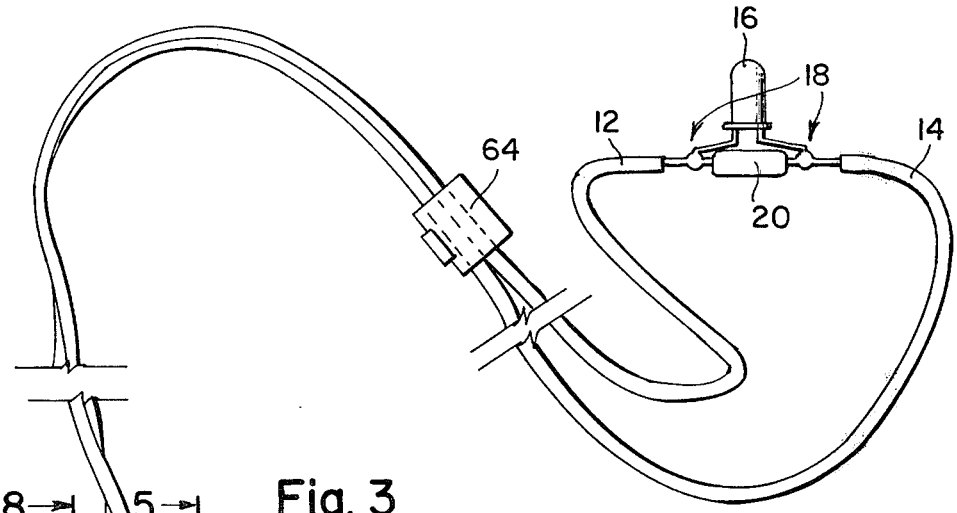
FIG. 3 is a top plan view, partly broken away, of the article of jewelry shown in FIG. 2.
Figure 5:
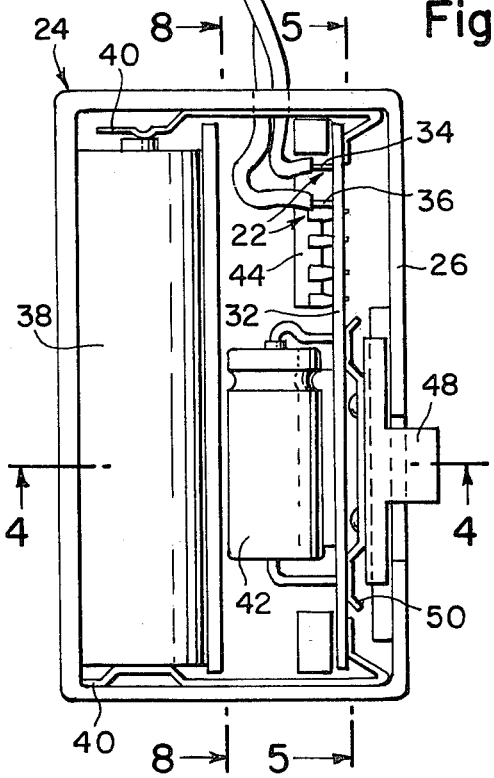
FIG. 5 is a side elevational exploded view of the electronics receptacle shown in FIG. 3 taken along line 5—5 thereof.
Figure 5:
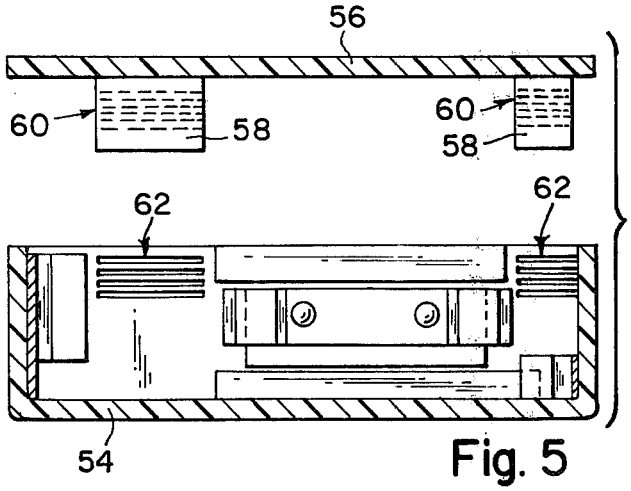
Figure 4:
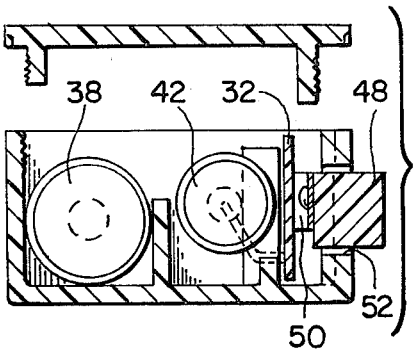
FIG. 4 is an end elevational exploded view of the electronics receptacle shown in FIG. 3 taken along line 4—4 thereof.

Referring next to FIGS. 3 to 5 there is shown the electronics package 24. As stated above, this package includes receptacle 26 which is desirably fabricated from a plastics material. The specific type of plastics material employed is not critical and, for example, polyethylene, polypropylene, and other of the synthetic polymers and copolymers readily available may be used to form the electronics receptacle.

Figure 6:
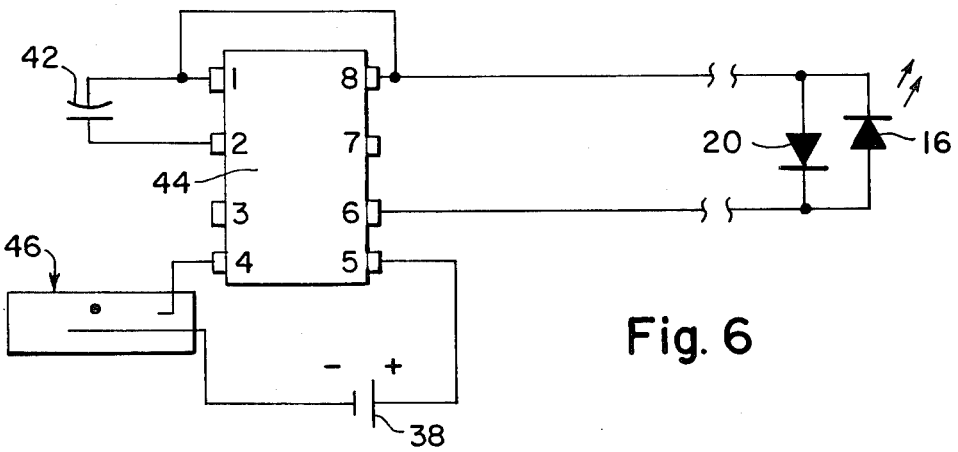
FIG. 6 is a schematic view of one electric circuit suitable with the article of jewelry of the invention.
Figure 7:
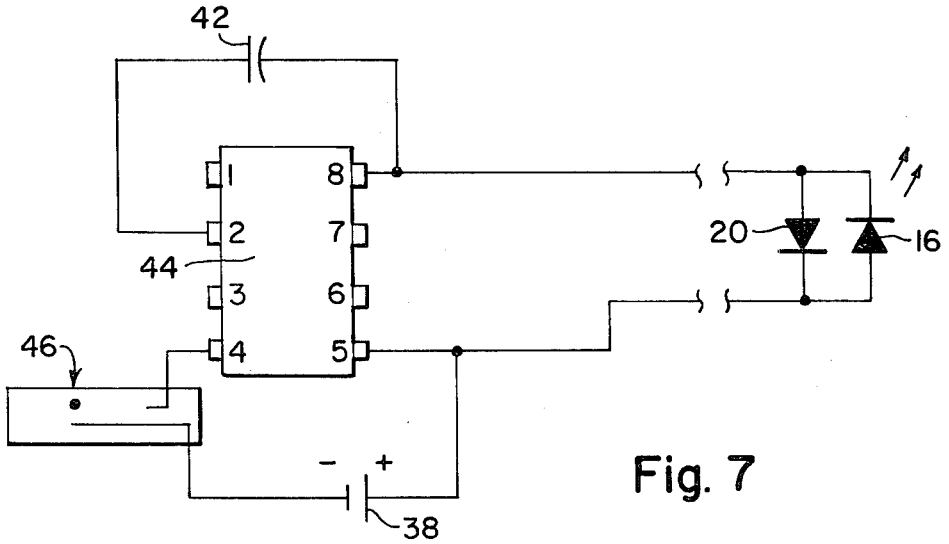
FIG. 7 is a schematic view of another electric circuit suitable with the article of jewelry.

It can be seen most clearly from FIG. 3 that the receptacle, in the presently preferred form of the invention, contains therein a printed circuit board 32 having lead out wire connection points 34, 36 into which the second set of free ends 22 are joined such as by soldering. However, it will be understood that the set of free ends 22 and the terminals of the printed circuit board may be connected electrically by any of the known expedients such as by means of male and female connecting elements. A single cell battery 38 is positioned within the receptacle and may be maintained in correct disposition by means of a pair of buss strip contactors 40 secured within the receptacle adjacent each of the opposed sides thereof. The buss contactors also connects the power cell with the printed circuit board as is well known. The battery is desirably of 1.5 volt capacity. However, it is within the contemplation of the invention to employ a cell of greater or lesser capacity providing portability of the article is not affected adversely. A capacitor 42, preferably a 220 microfarad electrolytic capacitor, is situated within the receptacle and is connected in the circuit across the pins of the chip in a manner which will be apparent to persons skilled in the art. Two arrangements found to be eminently satisfactory are shown in FIGS. 6 and 7. The linear integrated oscillator circuit 44 is the LM3909 manufactured by National Semiconductor Corp. and is electrically connected to the printed circuit board 32 so as to form a part of the circuit for intermittently effecting the flashing of the light emitting diode 16. The chip 44 is desirably connected in one of the circuits shown in FIGS. 6 and 7. A switch 46 is connected in series with battery 38 and may be of the mercury type although, as will be recognized, other appropriate types of switches may be employed. In FIGS. 3 and 4 it will be observed that a slide switch 48 with a metal contactor 50 are carried within a longitudinally extending slot 52 of the receptacle.

The receptacle as shown comprises a base member 54 within which the previously described electrical components are contained and a separable cover member 56. The cover member is given one or more tab elements 58 which depend therefrom and are provided with serrations 60 for a purpose which will become clear. Such serrations are preferably formed on the outer surface of the tab elements so as to be cooperable with mating serrations 62 formed on the inner surfaces of base member 54 at corresponding locations. Thus, when the cover member is placed on the base member and the tab elements urged into seating relation within the base member the serrations on the tab elements and on the base member coact to releasably retain the cover member on the base member. It will be appreciated that although the preferred from of the invention involves dimensioning the cover member and its tab elements and the base member so as to permit reception of the tab elements within the base member it is possible to reverse the juxtapositioning of the cover and base members so as to permit fitting of the cover member over and externally of the base member. In such event, as will be evident, the serrations on the cover and base members will be formed in reverse pattern to accomodate cooperation between the mating surfaces. In either instance the dimensioning of the cover and base members in respect of the corresponding side and end walls should desirably be such that there is a snap or slightly force fit therebetween. A plastic clasp member 64 may be provided for sliding movement along the two conductor wires so as to allow of regulation of the size of the loop 66 to be worn around the neck of the wearer.

Referring to FIGS. 6 and 7 it will be understood that the integrated circuit, battery, capacitor and diodes areall commercially available components which are electrically interconnected as shown by means of printed circuit board 32. In the schematic of FIG. 7 it is possible to also incorporate an external resistor to shunt the internal RC resistors of the chip between appropriate pins thereof. The flashing rate of the circuit can be increased in this manner. Other circuit modifications are also possible, as will be apparent to persons versed in the art, in order to adapt the circuit to the intended use and there appears to be no reason to unnecessarily encumber the present disclosure in this respect. It will further be recognized that the circuit of FIG. 7 draws less current than the circuit of FIG. 6. Other circuit arrangements are shown and discussed in the publication of National Semiconductor Corp., App;ication Note AN-154, pages AN 154-1 and AN-154-2 by Peter Lefferts, December, 1975.

Figure 8:
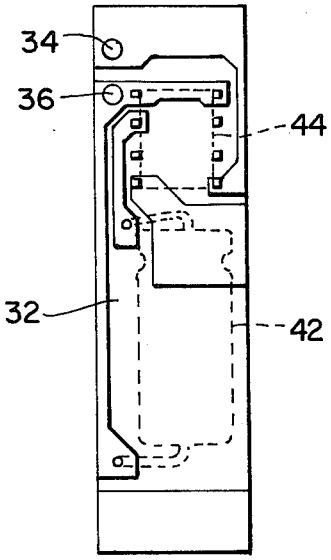
FIG. 8 is an elevational view of the printed circuit board shown in FIG. 3 taken along line 8—8 thereof.

As shown in FIG. 8 the printed circuit board 32 is desirably maintained within the base of receptacle 26 by means of the end portions of buss strip contactors 40. The various components of the electrical circuit such as switch 48, capacitor 42, diodes 16 and 20 and integrated circuit 44 are thus retained in proper operational relationship. It will, of course, be appreciated that the printed circuit board illustrated will be modified to accomodate the required interconnection between such components.

Although the invention has been described in specific terms it will be understood that various changes may be made in size, shape, materials and in the arrangement of the parts within departing from the spirit and scope of the invention as claimed.

Having thus set forth the nature of the invention, what is claimed herein is:

1. An article of jewelry comprising first and second lengths of electrically conductive wire; a light emitting diode connected across a first set of the free ends of said lengths of wire; a restraining diode connected across said lengths of wire inwardly of and proximate to the connection between said light emitting diode and said lengths of wire, said restraining diode being connected in opposition to the direction of current flow through said light emitting diode; and a linear integrated oscillator circuit and low voltage power source connected across the other set of free ends of the said wire lengths adapted to intermittently flash said light emitting diode at a predetermined frequency.

2. An article of jewelry according to claim 1, wherein said power source comprises a single cell battery having a voltage of not more than approximately 1.5 volts.

3. An article of jewelry according to claim 1 or 2, in the form of a necklace.

4. An article of jewelry according to claim 1 or 2, wherein the lead-out wires for said restraining diodes are of greater diameter than those of said light emitting diode.

5. An article of jewelry according to claim 4, including a receptacle within which said linear integrated circuit and said power source are positioned, a printed circuit board being mounted within said receptacle, and said other set of free ends being connected electrically to said printed circuit board.

6. An article of jewelry according to claim 5, wherein said receptacle comprises a base member and a separable cover member, said cover member having at least one depending tab element provided with serrations thereon, said base member being given corresponding serrations on surfaces thereof at locations such that the serrations on said tab elements and on said base member are cooperable to releasably connect said cover and base members.

7. An article of jewelry accordng to claim 6, including a buss strip contactor within said base member adjacent each of opposed sides thereof, said buss strip contactors serving to retain said power source and printed circuit board in predetermined fixed relationship within the receptacle and to selectively electrically connect same.

8. An article of jewelry according to claim 7, including a longitudinally extending slot in a wall of said base member adjacent said printed circuit board and slide switch means slidably mounted in said slot engageable with contacts on said printed circuit board for energizing said oscillator circuit.

9. An article of jewelry according to claim 8, wherein said restraining diode comprises a germanium glass diode.

10. An article of jewelry according to any of claims 5, 6, 7, 8, or 9 in the form of a necklace.

11. An article of jewelry according to claim 4 in the form of a necklace.

12. An article of jewelry according to claim 10, including a chain element secured to said receptacle of sufficient length to be worn about the neck of the wearer, said light emitting diode being positioned within said receptacle, and a transparent or translucent window in a face of said receptacle through which the flashing light generated by said light emitting diode is visible.

* * * * *